United States Patent [19]

Strauss

[11] Patent Number: 4,745,328

[45] Date of Patent: May 17, 1988

[54] CRT TENSION MASK SUPPORT STRUCTURE

[75] Inventor: Paul Strauss, Chicago, Ill.

[73] Assignee: Zenith Electronics Corporation, Glenview, Ill.

[21] Appl. No.: 942,336

[22] Filed: Dec. 16, 1986

[51] Int. Cl.[4] ..... H01J 29/81

[52] U.S. Cl. ..... 313/402; 313/407; 313/408

[58] Field of Search ..... 313/402, 407, 408

[56] References Cited

U.S. PATENT DOCUMENTS

| | | | |
|---|---|---|---|
| 2,625,734 | 1/1953 | Law | 29/25.13 |
| 2,842,696 | 7/1958 | Fischer-Colbrie | 313/78 |
| 2,905,845 | 9/1959 | Vincent | 313/78 |
| 3,030,536 | 4/1962 | Hackett et al. | 313/80 |
| 3,284,655 | 11/1966 | Oess | 313/286 |
| 3,638,063 | 1/1972 | Tachikawa et al. | 313/348 |
| 3,727,087 | 4/1973 | Steinberg et al. | 313/91 |
| 3,894,321 | 7/1975 | Moore | 29/25.15 |
| 4,045,701 | 8/1977 | Dougherty | 313/408 |
| 4,069,567 | 1/1978 | Schwartz | 29/25.15 |
| 4,087,717 | 5/1978 | Lerner | 313/406 |
| 4,100,451 | 7/1978 | Palac | 313/404 |
| 4,547,696 | 10/1985 | Strauss | 313/407 |

OTHER PUBLICATIONS

Robinder et al., "A High-Brightness Shadow Mask Color CRT for Cockpit Displays", Tektronix Inc., Beaverton, OR, 1983.

Fyler et al., "The CBS Colortron: A Color Picture Tube of Advanced Design", Proceedings of the IRE.

*Primary Examiner*—David K. Moore

*Assistant Examiner*—Sandra L. O'Shea

[57] ABSTRACT

An improved front assembly for a color cathode ray tube having a tension foil shadow mask is disclosed. The faceplate of the tube has on its inner surface a centrally disposed phosphor screen surrounded by a peripheral sealing area adapted to mate with a funnel. The assembly includes a shadow mask support structure for securing a shadow mask in tension on the structure and spacing the shadow mask from the screen. The support structure is provided by a support assembly including an inverted channel member to facilitate securing the shadow mask to the support structure. A stiffening core is secured within the channel member. A rigid bar may be secured to the top of the channel member for securing the shadow mask thereto.

35 Claims, 4 Drawing Sheets

CRT TENSION MASK SUPPORT STRUCTURE

CROSS-REFERENCE TO RELATED APPLICATIONS

This application is related to but in no way dependent upon copending applications Ser. No. 832,493, filed Feb. 21, 1986; Ser. No. 831,699, filed Feb. 21, 1986; Ser. No. 832,556, filed Feb. 21, 1986; Ser. No. 835,845, filed Mar. 3, 1986; and Ser. No. 866,030, filed May 21, 1986, all of common ownership herewith.

FIELD OF THE INVENTION

This invention generally relates to color cathode ray picture tubes and, specifically, to a novel front assembly for color tubes that have a tension foil shadow mask. The invention is useful in color tubes of various types including those used in home entertainment television receivers, and those used in medium-resolution and high-resolution tubes intended for color monitors.

BACKGROUND OF THE INVENTION

The use of the tension foil mask and a flat faceplate provides many advantages and benefits in comparison with the conventional curved or domed shadow mask. Chief among these is a greater power-handling capability which makes possible as much as a three-fold increase in brightness. The conventional curved shadow mask, which is not under tension, tends to "dome" in high-brightness picture areas where the intensity of electron bombardment is greatest. Color impurities result as the mask moves closer to the faceplate. Being under high tension, the tension foil mask does not dome or otherwise move in relation to the faceplate. Therefore, it has greater brightness potential while maintaining color purity.

The tension foil shadow mask is a part of the cathode ray tube front assembly, and is located in close adjacency to the faceplate. The front assembly comprises the faceplate with its deposits of light-emitting phosphors, a shadow mask, and support means for the mask. As used herein, the term "shadow mask" means an apertured metallic foil which may have a thickness, by way of example, of about one mil or less. The mask must be supported in high tension a predetermined distance from the inner surface of the cathode ray tube faceplate. This distance is known as the "Q-distance." The high tension may be in the range of 20 to 40 kpsi. As is well known in the art, the shadow mask acts as a color-selection electrode, or parallax barrier, which ensures that each of the three color beams lands only on its assigned phosphor deposits.

The requirements for the support means for the shadow mask are stringent. As has been noted, the shadow mask must be mounted under high tension. The mask support means must be of high strength so that the mask is held immovable. An inward movement of the mask of as little as one-tenth of a mil is significant in that guard band may be expended. Also, the shadow mask support means must be of such configuration and material composition as to be compatible with the means to which it is attached. As an example, if the support means is attached to glass such as the inner surface of the faceplate, the support means must have about the same thermal coefficient of expansion as that of the glass. The support means must provide a suitable surface for mounting the mask. Also, the support means must be of a composition such that the mask can be welded onto it by electrical resistance welding or by laser welding. The support surface preferably is of such flatness that no voids can exist between the metal of the mask and the support structure to prevent the intimate metal-to-metal contact required for proper welding.

A tension mask registration and supporting system is disclosed by Strauss in U.S. Pat. No. 4,547,696 of common ownership herewith. A frame dimensioned to enclose the screen comprises first and second space-apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. When the system is assembled, the frame is located between the sealing lands of the faceplate and a funnel, with the stiffening member projecting from the frame into the funnel. While the system is feasible and provides an effective means for holding a mask under high tension and rigidly planoparallel with a flat faceplate, weight is added to the cathode ray tube, and additional process steps are required in manufacture.

There exists in the marketplace today a color tube that utilizes a tensed shadow mask. The mask is understood to be placed under high tension by purely mechanical means. Specifically, a very heavy mask support frame is compressed prior to and during affixation of the mask to it. Upon release of the frame, restorative forces in the frame cause the mask to be placed under high residual tension. During normal tube operation, electron beam bombardment causes the mask to heat up and the mask tension to be reduced. An upper limit is placed on the intensity of the electron beams that may be used to bombard the screen without causing the mask to relax completely and lose its color selection capability. The upper limit has been found to be below that required to produce color pictures of the same brightness as are produced in tubes having non-tensed shadow masks. For descriptions of examples of this type of tube, see U.S. Pat. No. 3,683,063 to Tachikawa.

Other prior art include: Lerner—U.S. Pat. No. 4,087,717; DoughertyW—U.S. Pat. No. 4,045,701; Palac—U.S. Pat. No. 4,100,451; Law—U.S. Pat. No. 2,625,734; Steinberg et al—U.S. Pat. No. 3,727,087; Schwartz—U.S. Pat. No. 4,069,567; Moore—U.S. Pat. No. 3,894,321; Oess—U.S. Pat. No. 3,284,655; Hackett—U.S. Pat. No. 3,303,536; Hackett et al—U.S. Pat. No. 3,030,536; Vincent—U.S. Pat. No. 2,905,845; Fischer-Colbrie—U.S. Pat. No. 2,842,696; Law—U.S. Pat. No. 2,625,734; a journal article: "The CBS Colortron: A color picture tube of advanced design." Fyler et al. Proc. of the IRE, Jan. 1954. Dec. class R583.6; and a digest article: "A High-Brightness Shadow-Mask Color CRT for Cockpit Displays." Robinder et al. Society for Information Display, 1983.

OBJECTS OF THE INVENTION

A general object of the invention is to provide an improved front assembly for tension foil shadow mask tubes.

Another general object of the invention is to provide a tension foil shadow mask support structure that is low in cost and light in weight.

A further object of the invention is to provide a tension foil shadow mask support structure that can be mounted on a faceplate for receiving a tension foil shadow mask.

Still another object of the invention is to provide a tension foil shadow mask support structure that is capable of holding a tension foil shadow mask firmly in registration under high electron beam bombardment.

Yet a further object of the invention is to provide a tension foil shadow mask support structure that simplifies manufacture and lowers manufacturing costs.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the figures of which like reference numerals identify like elements, and in which:

Description Of The Preferred Embodiment

Figure 1:
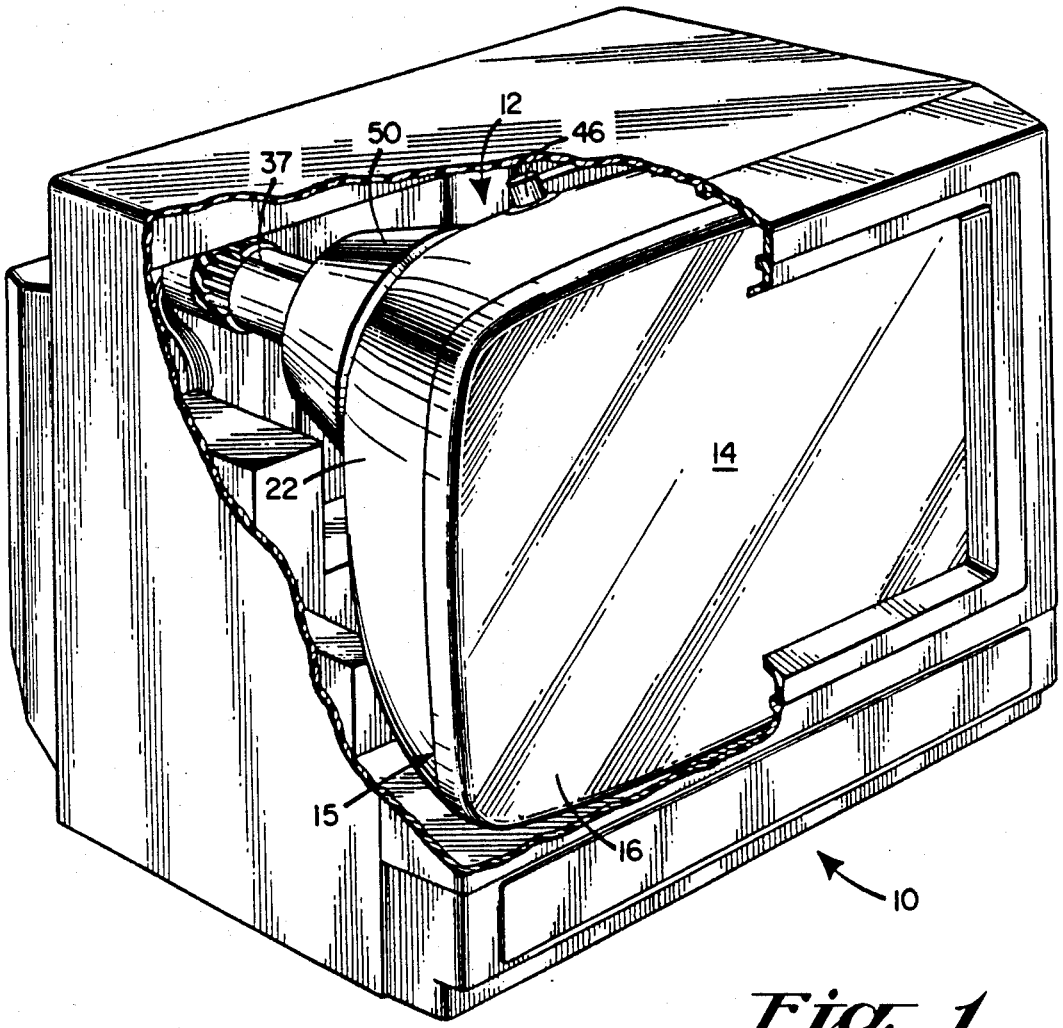
FIG. 1 is a cut-away perspective view of a cabinet housing a cathode ray tube having a front assembly according to the invention.

FIG. 1 depicts a video monitor, generally designated 10, that houses a color cathode ray tube, generally designated 12, having a novel front assembly according to the invention. The design of the video monitor is the subject of copending design patent application Ser. No. 725,040 of common ownership herewith. The monitor-associated tube is notable for the flat imaging area 14 that makes possible the display of images in undistorted form. Imaging area 14 also offers a more efficient use of screen area as the corners are relatively square in comparison with the more rounded corners of the conventional cathode ray tube. The front assembly according to the invention comprises the components described in the following paragraphs.

Figure 2:
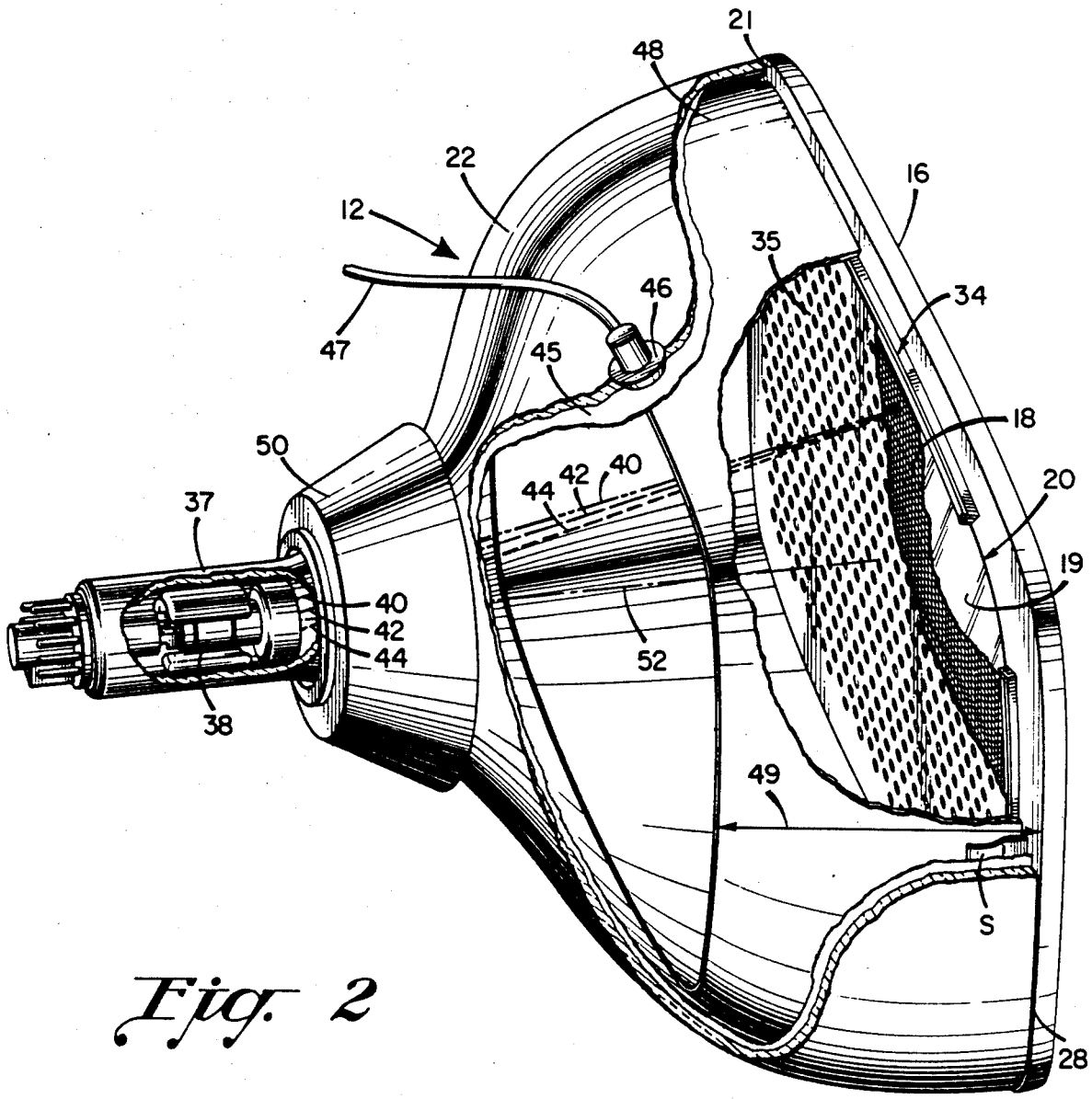
FIG. 2 is a cut-away side perspective view of the color cathode ray tube of FIG. 1, illustrating the location of the shadow mask support structure incorporating the concepts of the invention.
Figure 3:
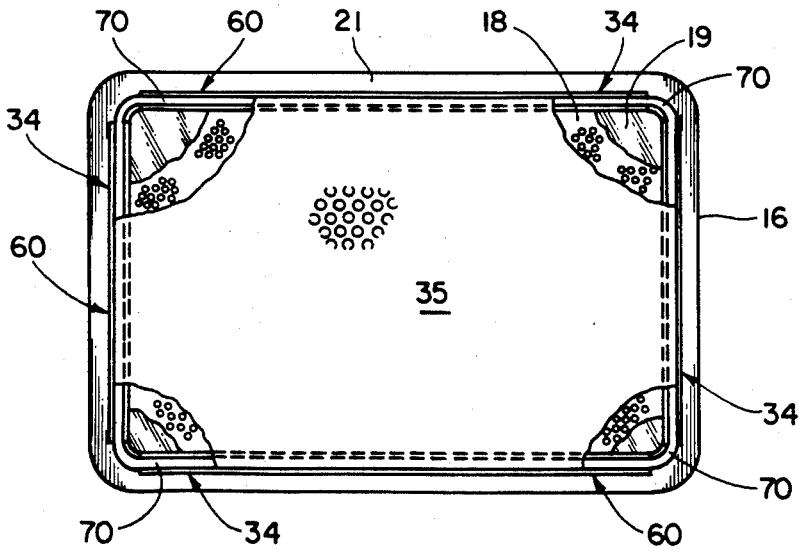
FIG. 3 is a plan view showing the relationship of the shadow mask support structure to the inner surface of the cathode ray tube faceplate shown in FIG. 2.
Figure 4:
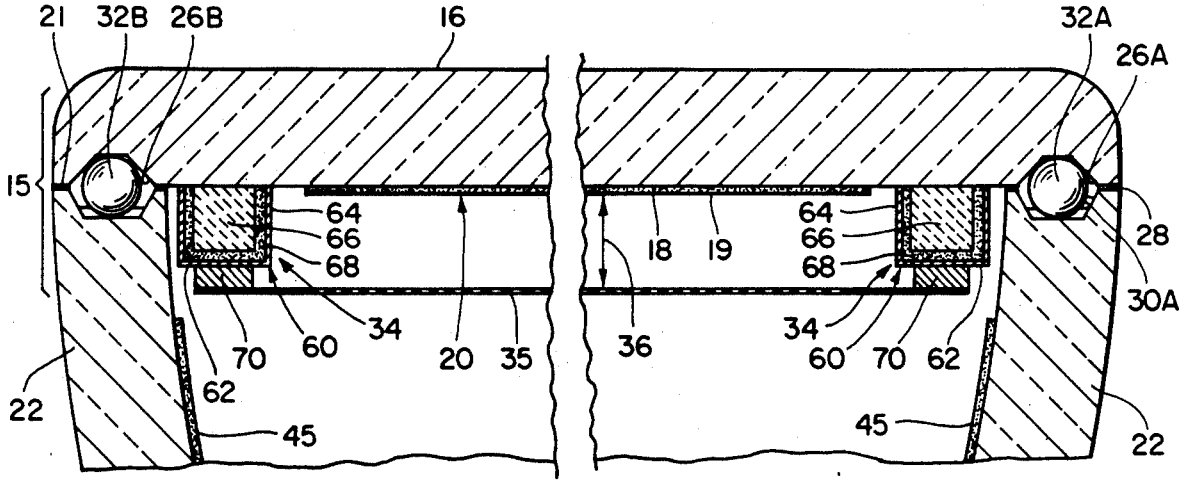
FIG. 4 is a broken section, on an enlarged scale, taken through the front assembly generally on the axis of the cathode ray tube, and illustrating the details of one embodiment of the tension shadow mask support structure of the invention.

With reference also to FIGS. 2, 3 and 4, a front assembly 15 (FIG. 4) for a high-resolution color cathode ray tube is depicted, the general scope of which is indicated by the bracket. Front assembly 15 includes a glass faceplate 16 noted as being flat, or alternately, "substantially" flat in that it may have finite horizontal and vertical radii. Faceplate 16, depicted in this embodiment of the invention as being planar and flangeless, has on its inner surface a centrally disposed phosphor target area 18, on which is deposited an electrically conductive film 19. Phosphor target area 18 and conductive film 19 comprise the electron beam target area, commonly termed a "screen," generally designated 20, which serves, during manufacture, for receiving a uniform coat of phosphor slurry. Conductive film 19, which is deposited on the phosphor deposits in a final step, typically consists of a very thin, light-reflective, electron-pervious film of aluminum.

Screen 20 is surrounded by a peripheral sealing area 21 adapted to be mated with a funnel 22. Sealing area 21 is represented as having three substantially radially oriented first indexing V-grooves therein, only two grooves 26A and 26B being shown in FIG. 4. The indexing grooves preferably are peripherally located at equal angular intervals about the center of faceplate 16; that is, at 120-degree intervals. Indexing grooves 26A and 26B are shown in FIG. 4. The third indexing groove is not shown; however, it is also located in peripheral sealing area 21 equidistantly from indexing elements 26A and 26B. The V-shaped indexing grooves provide for indexing faceplate 16 in conjunction with a mating envelope member, as will be shown.

Funnel 22 has a funnel sealing area 28 with second indexing elements or grooves 30A and 30B therein in like orientation, and depicted in FIG. 4 in facing adjacency with the first indexing elements 26A and 26B. Ball means 32A and 32B, which provide complementary rounded indexing means, are conjugate with the indexing grooves or elements 26A and 26B and 30A and 30B for registering the faceplate 16 and the funnel 22. The first indexing elements together with the ball means are also utilized as indexing means during the photoscreening of the phosphor deposits on the faceplate.

Front assembly 15 according to the invention includes a tension foil mask support structure, generally designated 34, secured to the inner surface of faceplate 16 between screen 20 and peripheral sealing area 21 and enclosing the phosphor target 18. The support structure provides for supporting a tension foil shadow mask 35 a predetermined "Q-distance" from the inner surface of faceplate 16. The predetermined distance may comprise the "Q-distance" 36, as indicated by the associated arrow in FIG. 4. The mask, indicated as being planar, is depicted as being stretched in all directions in the plane of the mask.

As seen in FIG. 2, a neck 37 extending from funnel 22 is represented as housing an electron gun 38 which is indicated as emitting three electron beams 40, 42 and 44 that selectively activate phosphor target 18, noted as comprising colored-light emitting phosphor deposits overlayed with a conductive film 19. Beams 40, 42 and 44 serve to selectively activate the pattern of phosphor deposits after passing through the parallax barrier formed by shadow mask 35.

Funnel 22 is indicated as having an internal electrically conductive funnel coating 45 adapted to receive a high electrical potential. The potential is depicted as being applied through an anode button 46 attached to a conductor 47 which conducts a high electrical potential to the anode button 46 through the wall of funnel 22. The source of the potential is a high-voltage power supply (not shown). The potential may be, for example, in the range of 18 to 26 kilovolts in the illustrated monitor application. Means for providing an electrical connection between the electrically conductive support structure 34 and funnel coating 45 may comprise spring means "S" (depicted in FIG. 2).

A magnetically permeable internal magnetic shield 48 is shown as being attached to support structure 34. Shield 48 extends into funnel 22 a predetermined distance 49 which is calculated so that there is no interference with the excursion of the electron beams 40, 42 and 44, yet maximum shielding is provided.

A yoke 50 is shown as encircling tube 12 in the region of the junction between funnel 22 and neck 37. Yoke 50 provides for the electromagnetic scanning of beams 40, 42 and 44 across the screen 20. The center axis 52 of tube 12 is indicated by the broken line.

Figure 5:
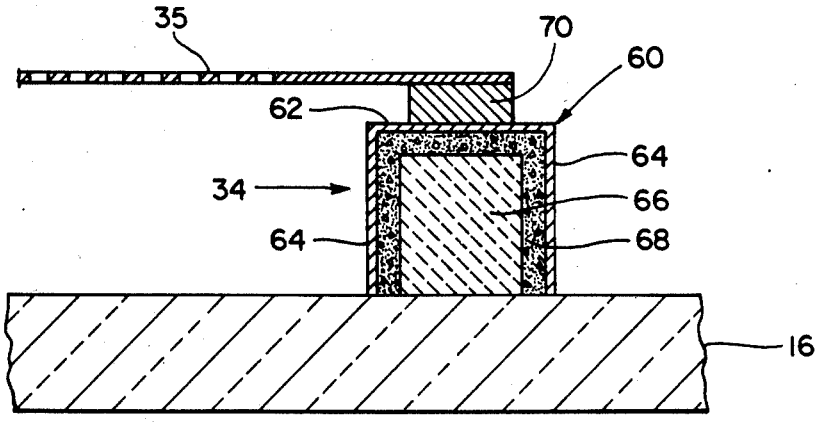
FIG. 5 is a fragmented sectional view through the tension shadow mask support structure of FIG. 4, on an enlarged scale and inverted in relation to that shown in FIG. 4.

Referring to FIG. 5 in conjunction with the previously described drawings, one embodiment of the support structure 34 provides means for securing shadow mask 35 in tension on the structure and spacing the shadow mask from screen 20. More particularly, support structure 34 comprises a support assembly including an inverted channel-shaped member, generally designated 60, having a cross portion 62 and depending leg portions 64, the cross portion defining a flattened ridge to facilitate securing the shadow mask to the support structure. A stiffening core 66 of a generally rectangular cross-sectional shape is secured within channel member 60 between leg portions 64. Stiffening core 66 is spaced from the inside surfaces of cross portion 64 and leg portions 66, and a filling material such as a hardened cement 68 substantially fills this space.

Channel-shaped member 60 is fabricated from relatively thin sheet metal material to define a shell and, in the form of the invention shown in FIGS. 4 and 5, completely surrounds stiffening core 66 when secured to faceplate 16. Since the top of support structure 34 must be coplanar to hold tension shadow mask 35 in flat condition, and since the sheet metal is relatively thin, a rigid metal bar 70 is secured to the top of cross portion 62 of the channel-shaped member as by fritting, brazing, welding, etc. This bar is considerably thicker than the sheet metal material of the channel-shaped member and, therefore, provides additional material that can be ground down to a precise planar configuration for welding shadow mask 35 to the top surface of the rigid bar.

The above-described assembly has a number of interrelated advantages. The channel-shaped member 60 can be made of a thin metal material in an inexpensive forming process. The thin dimensions afford less potential residual stress in any thermal bonding process required to affix the support structure to the glass faceplate 16, or in later thermal processing of the tube. Top bar 70 adds more grinding material to facilitate forming a planar support for the shadow mask. The top bar also facilitates continuing the support surface around the corners of the shadow mask, as described hereinafter. Core 66 not only adds stiffness to the support structure, but the core fills a substantial portion of channel member 60 and limits the amount of filling material 68 which could run out of the channel member. The stiffness afforded by core 66 improves color purity (i.e., dot alignment) throughout a substantial temperature range. In other words, the mask can undergo substantial heating by electron beam bombardment to the extent of doming without exhibiting a loss of color purity.

In the form of support structure 34 shown in FIGS. 4 and 5, the distal ends of legs 64, the bottom surface (as viewed in FIG. 5) of stiffening core 66 and the bottom surface of hardened cement 68 are coplanar for securing to the inner surface of faceplate 16. Stiffening core 66 preferably is fabricated of ceramic material. Hardened cement 68 may, for example, be a devitrifying glass frit well-known in the art, or a cold-setting cement such as a Sauereisen-type cement. The assembly of channel member 60, stiffening core 66 and hardened cement 68 is secured to the inner surface of faceplate 16 by a similar hardening cement, e.g. frit, either before or after rigid bar 70 is secured, as previously mentioned, to the top of the assembly.

Figure 7:
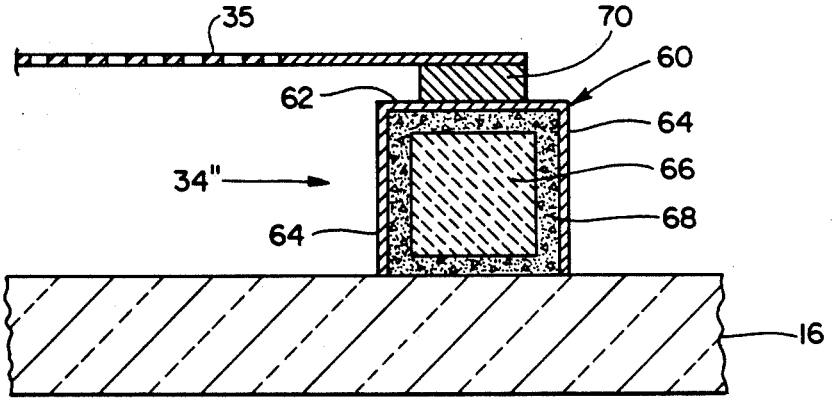
FIG. 7 is a further form of the embodiment of the shadow mask support structure of FIGS. 4 and 5.

FIG. 7 shows an alternate form of support structure 34'. In this form, leg portions 64 of channel-shaped member 60 project beyond the bottom surface of core 66 into substantial abutment with faceplate 16. This form makes it easy to simply use a doctor blade to level-off cement 68 even with the distal ends of leg portions 64 prior to hardening to insure a substantially planar surface. A rolled coating of hardenable cement then can be applied to secure the structure to the faceplate.

Figure 6:
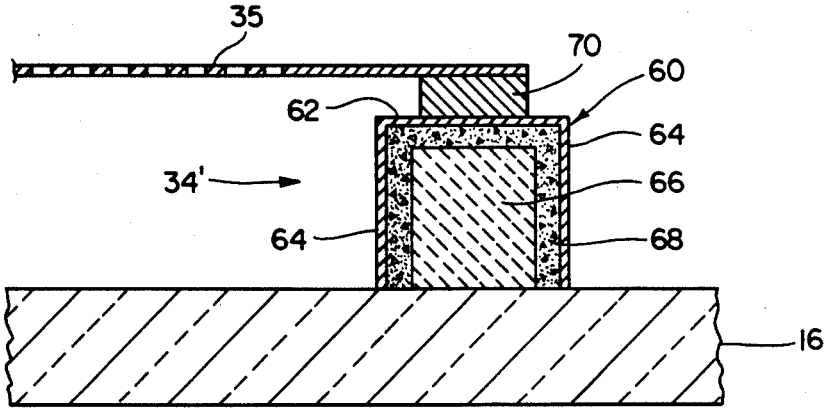
FIG. 6 is another form of the embodiment of the shadow mask support structure of FIGS. 4 and 5.

FIG. 6 shows a further form of support structure 34''. In this form, core 66 projects beyond the distal ends of leg portions 64 of channel-shaped member 60. This form makes it easier to establish the "Q-distance" 36 (FIG. 4) by simply grinding down the bottom surface of ceramic core 66. Top bar 70, of metal, then would have to be ground after the support structure is secured to the faceplate, only enough to level the support structure.

Figure 8:
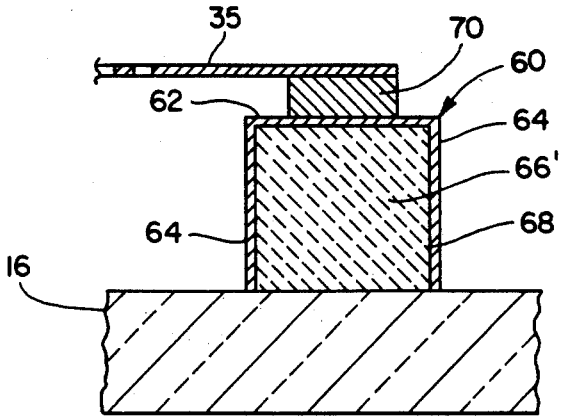
FIG. 8 is another embodiment of a shadow mask support structure according to the invention.
Figure 9:
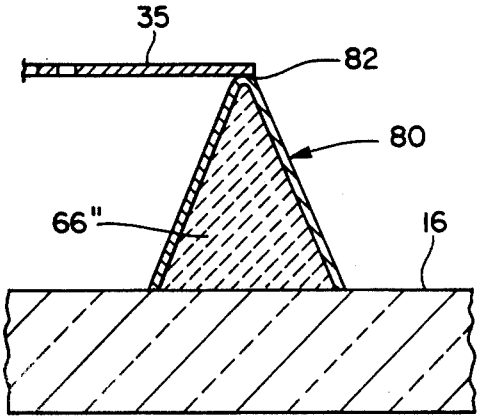
FIG. 9 is another form of the embodiment of the shadow mask support structure of FIG. 8.

FIGS. 8 and 9 show two different forms of another embodiment of the invention wherein a stiffening ceramic core 66' (FIG. 8) and 66'' (FIG. 9) completely fills the support structure. In FIG. 8, the support structure is similar to that of FIGS. 4 and 5 and like numerals have been applied to like components where applicable. In FIG. 9, the support structure includes a triangular channel member 80 of metal material which defines a ridge 82 for securing shadow mask 35 thereto, as by weld means.

Whereas core 66, in the support structure assembly of FIGS. 4 and 5, is preformed as a bar-like component prior to cementing within channel-shaped member 60, ceramic cores 66' (FIG. 8) and 66'' (FIG. 9) are effectively molded in place. In other words, a ceramic slurry is poured into channel member 60 or triangular member 80 and allowed to set. This completely eliminates the use of a hardened cement or frit 68 except that a coating of frit would be rolled on the bottom of the support structure for securing the support structure to faceplate 16. Alternate bonding schemes could include the bonding frit being applied to the faceplate first by such methods as silk screening. In the other forms of the invention above, generally two frit-application steps are required.

In order to understand the advantages of the embodiment of the invention shown in FIGS. 8 and 9, it should be noted that the cathode ray tube operates at as much as a $10^{-6}$ vacuum. It is important to avoid contamination or "poisoning" of the cathode by foreign substances such as air or moisture. This would smother the cathode and inhibit its proper emitting function. With this in mind, it can be understood that any voids in the structure of the shadow mask support structure could cause an outgassing problem during the life of the tube, if the normal exhaust processing at the tube could not sufficiently purge the voids. By completely filling channel member 60 or 80 with the hardened ceramic core, and then applying only a small coating of frit to secure the support structure to the faceplate, the exposed frit area and/or run-out is greatly reduced, thereby diminishing the outgassing problem.

Support structure 34 may substantially surround screen 20 to support welded-on tension foil shadow mask 35 in a location as shown in FIG. 2. On the other hand, the support structure may be fabricated in elongated linear sections and disposed on all four linear sides of the screen as shown in FIG. 3, with gaps at the four corners of the screen. However, since rigid bar 70 is fabricated of metal material, it may be substantially continuous about the screen as shown in FIG. 3, leaving the gaps between the ends of the linear sections beneath the rigid bar.

While particular embodiments of the invention have been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

What is claimed is:

1. A front assembly for a color cathode ray tube including a faceplate having on its inner surface a centrally disposed phosphor screen surrounded by a peripheral area adapted to mate with a funnel, said assembly including a shadow mask support structure for securing a shadow mask in tension upon said faceplate inner surface and for spacing the shadow mask from the screen, said support structure comprising a support assembly including an inverted channel member having a cross portion and depending leg portions, said cross portion defining a surface to facilitate securing the shadow mask to said support structure, and a stiffening core secured within said channel member between said leg portions of said channel member.

2. The front assembly of claim 1 wherein said stiffening core is secured within the channel member by hardened cement.

3. The front assembly of claim 2 wherein said stiffening core is spaced from the inside of the cross portion and leg portions of the channel member and said hardened cement substantially fills said space.

4. The front assembly of claim 1 wherein said support assembly includes a rigid bar on top of said cross portion for securing the shadow mask thereto.

5. The front assembly of claim 4 wherein said rigid bar is fabricated of metal.

6. The front assembly of claim 5 wherein the shadow mask is secured to said bar by weld means.

7. The front assembly of claim 1 wherein the bottom of said stiffening core and the distal ends of said leg portions are coplanar for securing the support assembly to the faceplate.

8. The front assembly of claim 1 wherein the bottom of the stiffening core extends beyond the distal ends of said leg portions.

9. The front assembly of claim 1 wherein the distal ends of said leg portions extend beyond the bottom of the stiffening core.

10. The front assembly of claim 1 wherein said support assembly is secured to the faceplate by hardened cement.

11. The front assembly of claim 1 wherein said stiffening core is fabricated of ceramic material.

12. The front assembly of claim 1 wherein said stiffening core is poured into the channel member in a slurry state and allowed to harden.

13. The front assembly of claim 12 wherein said stiffening core is fabricated of ceramic material.

14. a front assembly for a color cathode ray tube including a faceplate having on its inner surface a centrally disposed phosphor screen surrounded by a peripheral area adapted to mate with a funnel, said assembly including a shadow mask support structure for securing a shadow mask in tension upon said faceplate inner surface and for spacing the shadow mask from the screen, said support structure comprising a support assembly including a generally U-shaped inverted channel member having a cross portion and depending leg portions, said cross portion defining a surface, a stiffening core secured within said U-shaped channel member and spaced from the inside of the cross portion and leg portions of the channel member, hardened cement substantially filling the space between said stiffening core and said channel member and securing the stiffening core therewithin, and a rigid bar secured on top of said surface defined by said cross portion for securing said shadow mask thereto.

15. The front assembly of claim 14 wherein said rigid bar is flattened for securing to the shadow mask.

16. The front assembly of claim 15 wherein said rigid bar is fabricated of metal.

17. The front assembly of claim 16 wherein the shadow mask is secured to said rigid bar by weld means.

18. The front assembly of claim 14 wherein the bottom of said stiffening core and the distal ends of said leg portions are coplanar for securing the support assembly to the faceplate.

19. The front assembly of claim 14 wherein the bottom of the stiffening core extends beyond the distal ends of said leg portions.

20. The front assembly of claim 14 wherein the distal ends of said leg portions extend beyond the bottom of the stiffening core.

21. The front assembly of claim 14 wherein said support assembly is secured to the faceplate by hardened cement.

22. The front assembly of claim 14 wherein said stiffening core is fabricated of ceramic material.

23. A front assembly for a color cathode ray tube including a faceplate having on its inner surface a centrally disposed phosphor screen, said assembly including a shadow mask support structure for securing a shadow mask in tension upon said faceplate inner surface and for spacing the shadow mask from the screen, said support structure comprising a support assembly including an inverted metal channel member having a top surface for receiving and securing said shadow mask atop said channel member and further having depending leg portions to facilitate securing said support structure to said faceplate, and an inert stiffening core secured within said channel member.

24. The front assembly of claim 23 wherein the bottom of said stiffening core and the distal ends of said leg portions are coplanar for securing the support assembly to the faceplate.

25. The front assembly of claim 23 wherein said support assembly is secured to the faceplate by hardened cement.

26. The front assembly of claim 23 wherein said stiffening core is fabricated of ceramic material.

27. The front assembly of claim 23 wherein said stiffening core is poured into the channel member in a slurry state and allowed to harden.

28. The front assembly of claim 27 wherein said stiffening core is fabricated of ceramic material.

29. The front assembly of claim 28 wherein the bottom of said stiffening core and the distal ends of said leg portions are coplanar for securing the support assembly to the faceplate.

30. The front assembly of claim 28 wherein said support assembly is secured to the faceplate by hardened cement.

31. A front assembly for a color cathode ray tube including a faceplate having on its inner surface a centrally disposed phosphor screen, said assembly including a shadow mask support structure for securing a shadow mask in tension upon said faceplate inner surface and for spacing the shadow mask from the screen, said support structure comprising a support assembly including a thin metal outer shell and an inner stiffening core, said outer shell defining a surface to facilitate securing the shadow mask to said support structure, and a hardened cement for securing said support assembly to the faceplate.

32. The front assembly of claim 31 wherein said support assembly includes a rigid bar on top of said shell, the bar being flattened for securing the shadow mask thereto.

33. The front assembly of claim 31 wherein said rigid bar is fabricated of metal, said shadow mask is secured to the bar by weld means, said stiffening core is fabricated of ceramic material, and said support assembly is secured to the faceplate by hardened cement.

34. The front assembly of claim 31 wherein said stiffening core is poured into the channel member in a slurry state and allowed to harden.

35. The front assembly of claim 34 wherein said stiffening core is fabricated of ceramic material.

* * * * *